US009210997B2

(12) United States Patent
Repchuk

(10) Patent No.: US 9,210,997 B2
(45) Date of Patent: Dec. 15, 2015

(54) PAINT BRUSH CLEANING TOOL

(71) Applicant: Mary-Jean Elizabeth Repchuk, Weymouth, MA (US)

(72) Inventor: Mary-Jean Elizabeth Repchuk, Weymouth, MA (US)

( * ) Notice: Subject to any disclaimer, the term of this patent is extended or adjusted under 35 U.S.C. 154(b) by 0 days.

(21) Appl. No.: 14/658,195

(22) Filed: Mar. 15, 2015

(65) Prior Publication Data

US 2015/0289640 A1 Oct. 15, 2015

Related U.S. Application Data

(60) Provisional application No. 61/977,465, filed on Apr. 9, 2014.

(51) Int. Cl.

| | |
|---|---|
| ***A46B 17/06*** | (2006.01) |
| ***A46B 15/00*** | (2006.01) |
| *B44D 3/00* | (2006.01) |
| *B05C 21/00* | (2006.01) |
| *A45D 24/16* | (2006.01) |

(52) U.S. Cl.

CPC ..... *A46B 17/06* (2013.01); *A46B 15/0059* (2013.01); *A45D 24/16* (2013.01); *B05C 21/00* (2013.01); *B44D 3/006* (2013.01)

(58) Field of Classification Search

CPC ..... A46B 15/00; A46B 15/0055; A46B 15/0059; A46B 17/06; A45D 24/00; A45D 24/04; A45D 24/10; A45D 24/16; A45D 24/18; A45D 24/40; A45D 24/42; A45D 24/44; A45D 24/46; B44D 3/006; B05C 21/00

USPC ..... 15/104.5, 105, 111, 113, 142; 132/120, 132/126, 139, 148, 219; D4/116–118, 136; D28/21, 25, 28–31; D32/35, 42, 49, 51

See application file for complete search history.

(56) References Cited

U.S. PATENT DOCUMENTS

| | | | | | |
|---|---|---|---|---|---|
| 494,156 | A | * | 3/1893 | Koonce | F16C 33/18 106/257 |
| 939,290 | A | * | 11/1909 | Myers | A47L 13/502 15/142 |
| 2,856,622 | A | * | 10/1958 | Jacobsen | A46B 17/06 15/105 |
| 3,170,182 | A | | 2/1965 | Burian | |
| D240,338 | S | * | 6/1976 | Suchowski et al. | D28/29 |
| 3,999,244 | A | * | 12/1976 | Brickley | A47L 13/00 15/142 |
| 4,324,018 | A | | 4/1982 | Olsson | |
| 5,272,782 | A | | 12/1993 | Hutt | |
| D434,566 | S | * | 12/2000 | Mann | D32/35 |
| 6,421,860 | B1 | | 7/2002 | Abbott | |
| 6,427,274 | B1 | | 8/2002 | Abbott | |
| 6,530,109 | B1 | | 3/2003 | Cassedy | |
| 6,640,369 | B1 | | 11/2003 | Malvasio | |

(Continued)

FOREIGN PATENT DOCUMENTS

JP 2001-252126 * 9/2001

*Primary Examiner* — Mark Spisich

(74) *Attorney, Agent, or Firm* — Patentfile, LLC; Bradley C. Fach; Steven R. Kick

(57) ABSTRACT

A paint brush cleaning tool which may comprise: a handle; an apparatus head having a proximal end coupled to the handle and a distal end; a pick member comprising a plurality of pick teeth protruding outwards and away from the distal end of the apparatus head; and a rake member positioned proximate to the pick member and comprising a plurality of rake blades. The apparatus head may also include a brush member comprising a plurality of brush bristles protruding outwards and away from the apparatus head.

8 Claims, 6 Drawing Sheets

(56) References Cited

U.S. PATENT DOCUMENTS

| | | | | |
|---|---|---|---|---|
| 6,779,220 | B1 | 8/2004 | Raffa | |
| D509,925 | S * | 9/2005 | Morrow | D28/25 |
| 6,954,964 | B2 | 10/2005 | Parkkonen | |
| 7,266,858 | B2 * | 9/2007 | Cronin | A46B 17/06 15/105 |
| 7,661,173 | B2 | 2/2010 | Amos | |
| 8,276,238 | B2 | 10/2012 | Young | |
| 2003/0177597 | A1 | 9/2003 | Wallace | |
| 2014/0060562 | A1 * | 3/2014 | Diona | A45D 24/18 132/120 |

* cited by examiner

PAINT BRUSH CLEANING TOOL

CROSS REFERENCE TO RELATED APPLICATIONS

This application claims priority to and the benefit of the filing date of U.S. Provisional Application No. 61/977,465, filed on Apr. 9, 2014, entitled "A tool for cleaning paint out of fine art paint brushes", which is hereby incorporated by reference in its entirety.

FIELD OF THE INVENTION

This patent specification relates to the field of tools for assisting painters. More specifically, this patent specification relates to tools that facilitate the cleaning of paint applicators such as paint brushes and the like.

BACKGROUND

During the course of painting, paint will typically embed itself deep into the ferrule of paint applicators such as paint brushes, fine art brushes, and the like. Paint that has accumulated within the ferrule can adversely affect how paint is applied by a paint brush. This paint is not removed and allowed to dry, the bristles of the brush may become stiff or stuck together thereby decreasing the utility and lifespan of the paint brush.

Paint that has become embedded within the ferrule is very difficult to remove and clean efficiently. Currently, paint brushes are often cleaned by hand using a brush cleaning soap or by soaking brushes for a long time in a solvent such as water or mineral spirits. Unfortunately, techniques such as soaking brushes in solvent or just running them under water with soap, does not completely clean the ferrule of a fine art brush. Over time, even with diligent cleaning, paint will accumulate within the ferrule thereby decreasing the utility and lifespan of the paint brush. Since paint brushes and especially fine art brushes are expensive, a significant amount of time and money is wasted for their replacement.

Therefore, a need exists for novel tools that facilitate the cleaning of paint applicators such as paint brushes and the like. There is a further need for a novel tool that is able to remove paint that has become embedded within the ferrule of paint brushes. Finally, there exists a need for a novel tool that is able to prevent paint from accumulating within the ferrule over time thereby increasing the utility and lifespan of paint applicators such as paint brushes and the like.

BRIEF SUMMARY OF THE INVENTION

A paint brush cleaning tool which may facilitate the removal of paint from paint applicators such as a paint brush is provided. In some embodiments, the paint brush cleaning tool may comprise: a handle; an apparatus head having a proximal end coupled to the handle and a distal end; a pick member comprising a plurality of pick teeth protruding outwards and away from the distal end of the apparatus head; and a rake member positioned proximate to the pick member and comprising a plurality of rake blades.

In further embodiments, the apparatus head may be removably coupled to the handle.

In still further embodiments, the paint brush cleaning tool may comprise a handle; a handle extension coupled to the handle; an apparatus head having a proximal end coupled to the handle extension and a distal end; a pick member comprising a plurality of pick teeth protruding outwards and away from the distal end of the apparatus head; and a rake member positioned proximate to the pick member and comprising a plurality of rake blades.

In still further embodiments, the apparatus head may be removably coupled to the handle extension.

In even further embodiments, the tool may comprise a brush member comprising a plurality of brush bristles which may protrude outwards and away from the apparatus head.

BRIEF DESCRIPTION OF THE DRAWINGS

Some embodiments of the present invention are illustrated as an example and are not limited by the figures of the accompanying drawings, in which like references may indicate similar elements and in which.

DETAILED DESCRIPTION OF THE INVENTION

Figure 1:
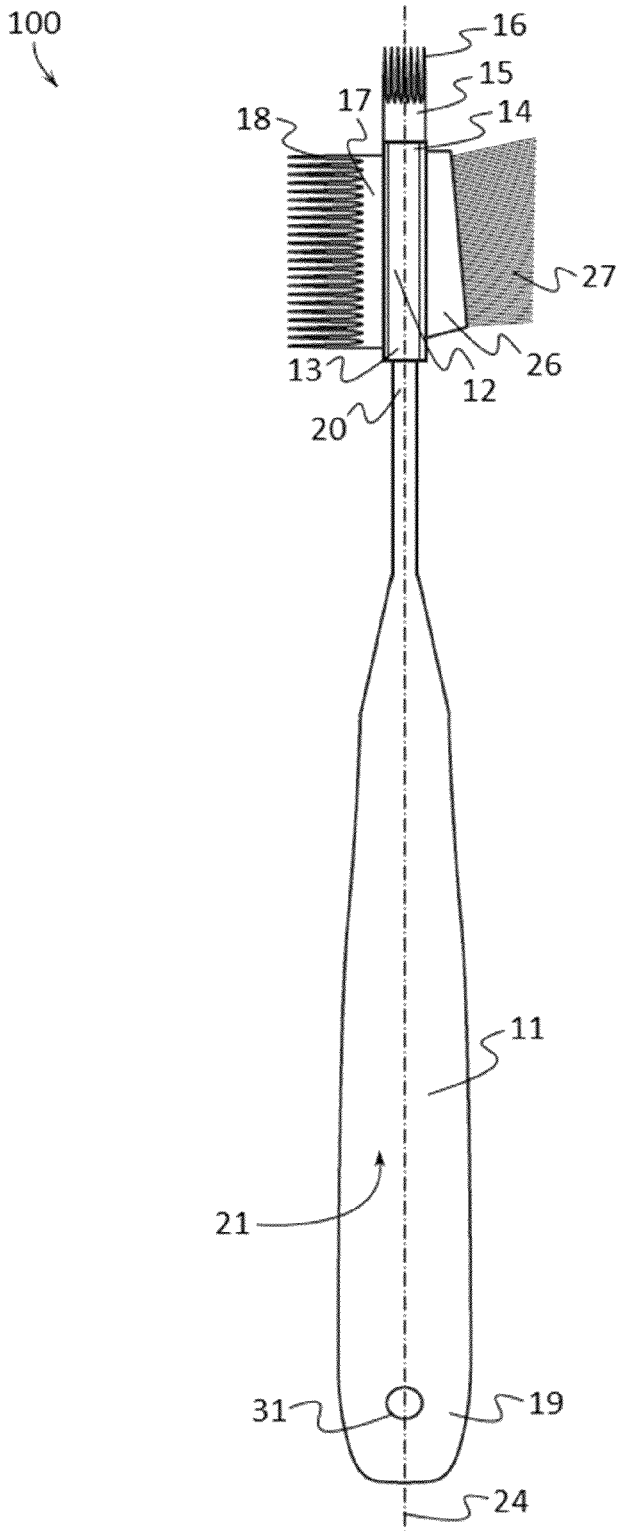
FIG. 1 depicts a side elevation view of an example of a paint brush cleaning tool according to various embodiments described herein.

The terminology used herein is for the purpose of describing particular embodiments only and is not intended to be limiting of the invention. As used herein, the term "and/or" includes any and all combinations of one or more of the associated listed items. As used herein, the singular forms "a," "an," and "the" are intended to include the plural forms as well as the singular forms, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof.

Unless otherwise defined, all terms (including technical and scientific terms) used herein have the same meaning as commonly understood by one having ordinary skill in the art to which this invention belongs. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein.

In describing the invention, it will be understood that a number of techniques and steps are disclosed. Each of these has individual benefit and each can also be used in conjunction with one or more, or in some cases all, of the other disclosed techniques. Accordingly, for the sake of clarity, this description will refrain from repeating every possible combination of the individual steps in an unnecessary fashion. Nevertheless, the specification and claims should be read with the understanding that such combinations are entirely within the scope of the invention and the claims.

New tools for assisting painters are discussed herein that are configured to facilitate the removal of paint and other coatings from paint applicators and the like. For purposes of description herein, the terms "side", "top", "bottom", and derivatives thereof shall relate to the invention as oriented in FIG. 1. However, one will understand that the invention may assume various alternative orientations and step sequences, except where expressly specified to the contrary. Therefore, the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

In the following description, for purposes of explanation, numerous specific details are set forth in order to provide a thorough understanding of the present invention. It will be evident, however, to one skilled in the art that the present invention may be practiced without these specific details.

The present disclosure is to be considered as an exemplification of the invention, and is not intended to limit the invention to the specific embodiments illustrated by the figures or description below.

The present invention will now be described by example and through referencing the appended figures representing preferred and alternative embodiments. FIG. 1 illustrates an example of a paint brush cleaning tool ("the tool") 100 according to various embodiments. In this example, the tool 100 comprises a handle 11; an apparatus head 12 having a proximal end 13 coupled to the handle 11 and a distal end 14; a pick member 15 comprising a plurality of pick teeth 16 protruding outwards and away from the distal end 14 of the apparatus head 12; and a rake member 17 positioned proximate to the pick member 15 and comprising a plurality of rake blades 18.

The handle 11 may comprise a first end 19 located generally towards the bottom of the tool 100 and a second end 20 located generally opposite to the first end 19. The handle 11 may comprise a grip surface 21 which may be configured to be gripped or grasped by the hand of a user allowing the user to manipulate the tool 100. Optionally, the handle 11 may comprise one or more apertures 31, depressions, and the like which may be used to hang or suspend the tool 100 when not in use. In some embodiments, the grip surface 21 and/or the handle 11 may be made from or comprise generally rigid materials such as hard plastics, metal alloys, wood, hard rubbers, carbon fiber, fiber glass, resins, polymers or any other suitable materials including combinations of materials. In further embodiments, the grip surface 21 and/or the handle 11 may be made from or comprise generally flexible or elastic materials such as silicone foams, rubber foams, plastic foams, neoprene foam, latex foam rubber, polyurenthane foam rubber, or elastomer materials such as elastic plastics, elastic silicone, elastic rubbers, silicone rubbers, or any other suitable elastomer or resilient material.

Figure 2:
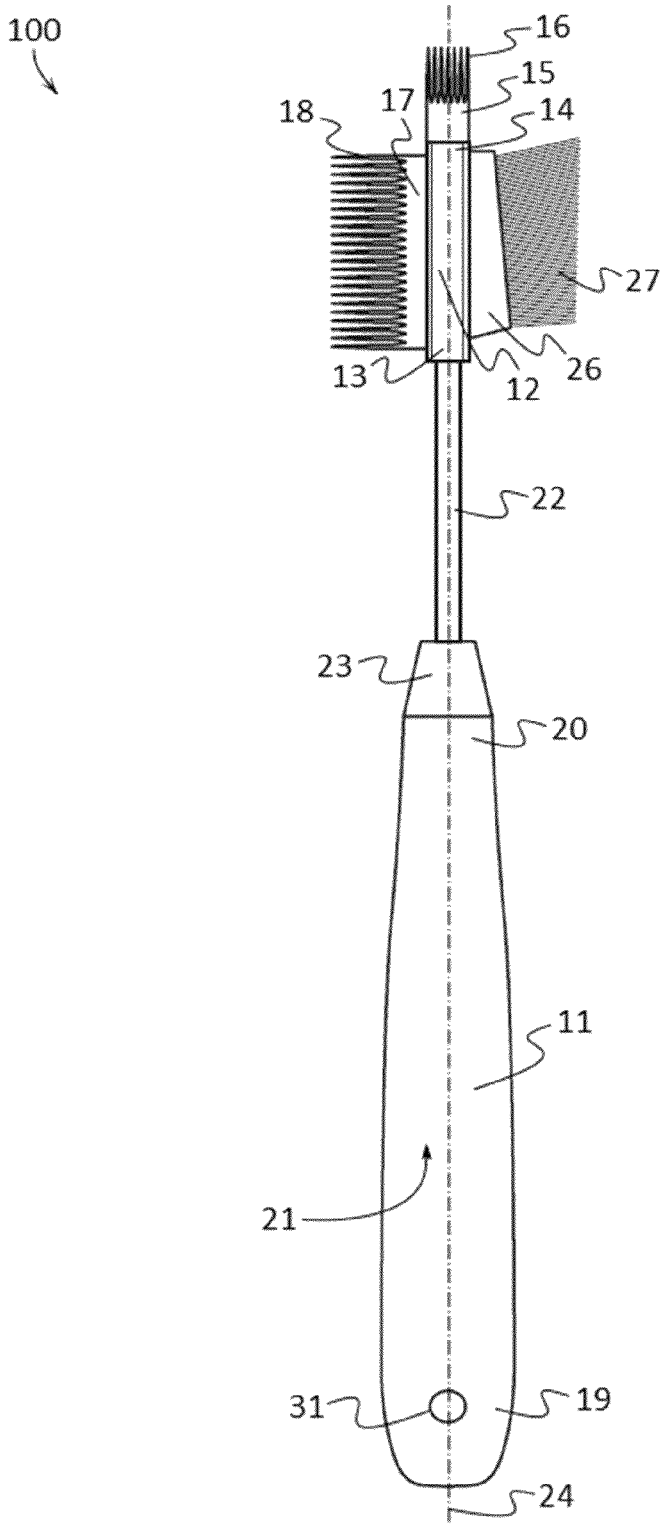
FIG. 2 illustrates a side elevation view of an alternative example of a paint brush cleaning tool according to various embodiments described herein.
Figure 3:
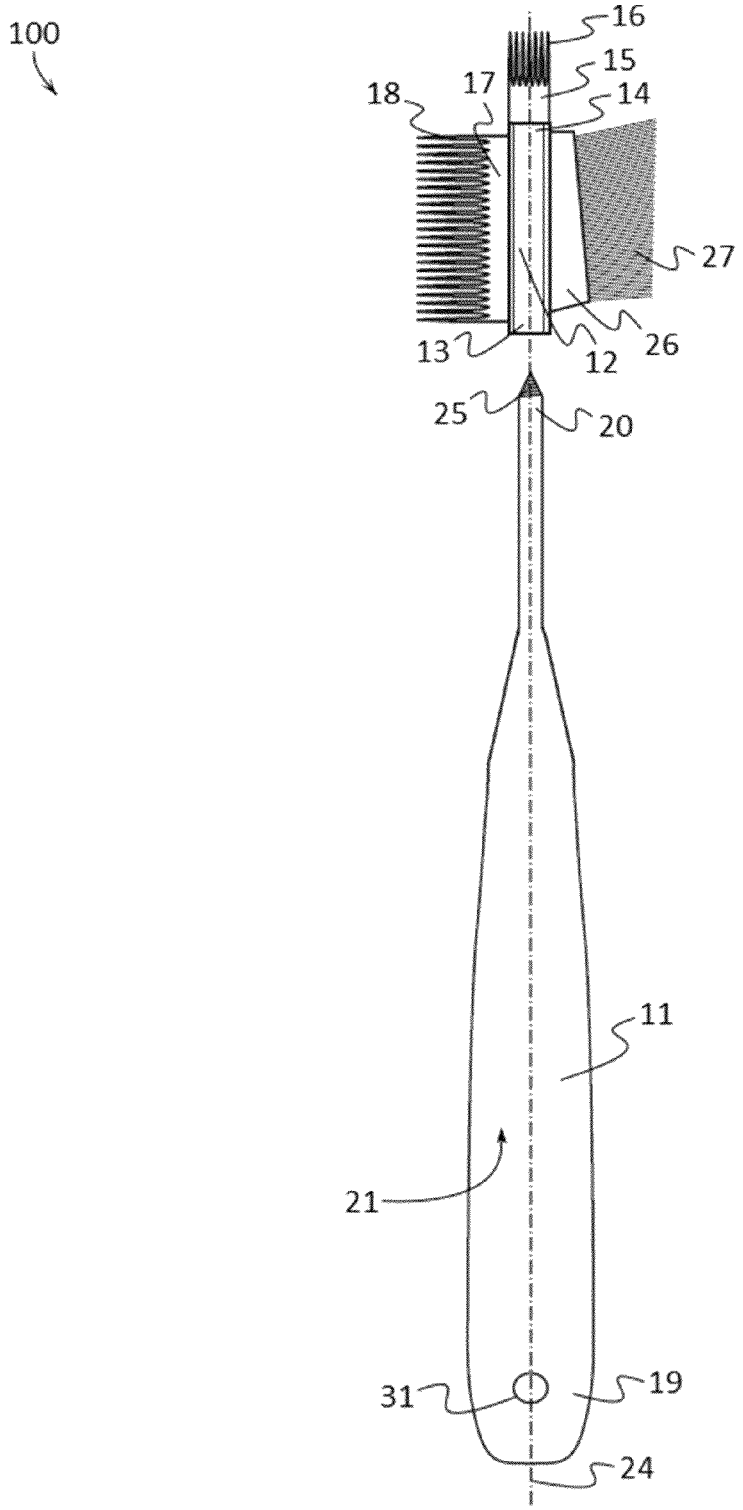
FIG. 3 illustrates a side elevation view of an alternative example of a paint brush cleaning tool according to various embodiments described herein.
Figure 4:
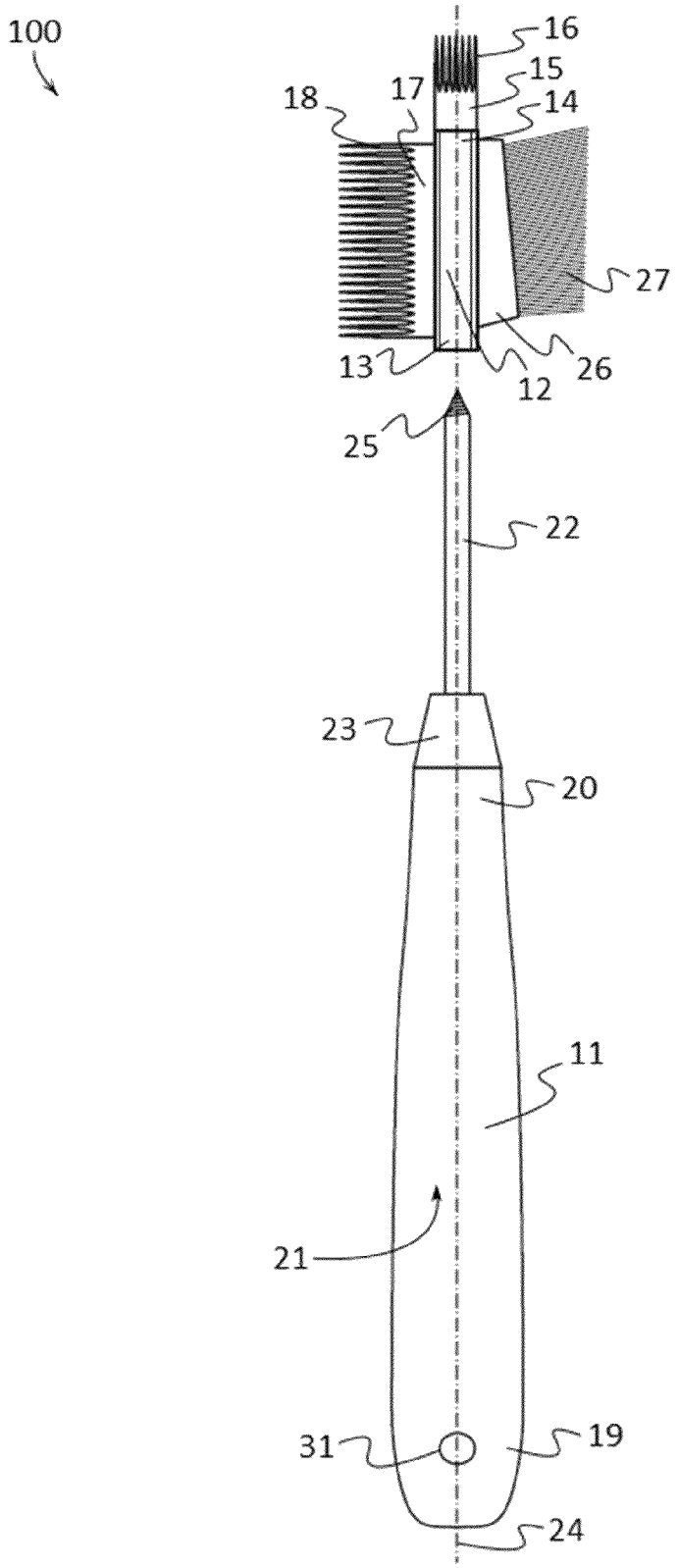
FIG. 4 shows a side elevation view of an alternative example of a paint brush cleaning tool according to various embodiments described herein.

The second end 20 of the handle 11 may be configured to be coupled to the apparatus head 12. In some embodiments and as shown in FIGS. 1 and 3, the second end 20 of the handle 11 may be coupled directly to the proximal end 13 of the apparatus head 12. In other embodiments and as shown in FIGS. 2 and 4, the tool 100 may comprise a handle extension 22 which may be configured to couple the proximal end 13 of the apparatus head 12 to the second end 20 of the handle 11 while extending or separating the apparatus head 12 and the handle 11. In the embodiments shown in FIGS. 2 and 4, the tool 100 may comprise a handle 11; a handle extension 22 coupled to the handle 11; an apparatus head 12 having a proximal end 13 coupled to the handle extension 22 and a distal end 14; a pick member 15 comprising a plurality of pick teeth 16 protruding outwards and away from the distal end 14 of the apparatus head 12; and a rake member 17 positioned proximate to the pick member 15 and comprising a plurality of rake blades 18.

A handle extension 22 may comprise a generally elongated shape and be configured in a plurality of lengths. In some embodiments, a tool 100 may comprise a handle extension 22 with a relatively short length thereby extending or separating the apparatus head 12 a relatively short length from the handle 11. In other embodiments, a tool 100 may comprise a handle extension 22 with a relatively long length thereby extending or separating the apparatus head 12 a relatively long length from the handle 11.

It should be understood to one of ordinary skill in the art that the handle 11 and an optional handle extension 22 (FIGS. 2 and 4) may be configured in a plurality of sizes and shapes including cylinder shaped, rectangular prism shaped, hexagonal prism shaped, triangular prism shaped, or any other geometric or non-geometric shape, including combinations of shapes. It is not intended herein to mention all the possible alternatives, equivalent forms or ramifications of the invention. It is understood that the terms and proposed shapes used herein are merely descriptive, rather than limiting, and that various changes may be made without departing from the spirit or scope of the invention.

In further embodiments, the handle 11, apparatus head 12, and optionally a handle extension 22 may be coupled by being connected, integrally formed, or molded together. In still further embodiments, the handle 11, apparatus head 12, and optional handle extension 22 may be made from injected molded nylon, glass filled nylon, fiber reinforced plastic, other plastics, metal alloys, carbon fiber, or other similar materials, and they may be coupled or connected together with heat bonding, chemical bonding, adhesives, clasp type fasteners, clip type fasteners, rivet type fasteners, threaded type fasteners, other types of fasteners, or any other suitable joining method. In still further embodiments, the handle 11 may be made from wood and the tool 100 may comprise a ring of containment 23 which may be coupled to the second end 20 of the handle 11 and made of metal or other rigid material which may be configured to receive a rivet type fastener which may be used to couple the handle 11 to the apparatus head 12. In even further embodiments, the tool 100 may comprise a ring of containment 23 which may be coupled to the second end 20 of the handle 11 and made of metal or other rigid material which may be configured to receive a rivet type fastener which may be used to couple the handle 11 to the handle extension 22.

The tool 100 may comprise a pick member 15 comprising a plurality of pick teeth 16 and a rake member 17 comprising a plurality of rake blades 18. The pick teeth 16 and rake blades 18 may be used to remove paint that has become embedded on or within the bristles and/or ferrule of paint applicators such as paint brushes and the like. By inserting and removing the pick member 15 into the bristles and/or ferrule of paint applicators, the pick teeth 16 may be used to break up and pull out embedded paint. Similarly, by inserting and removing the rake member 17 into the bristles and/or ferrule of paint applicators, the rake blades 18 may be used to break up and pull out embedded paint. A pick member 15 and a rake member 17 may be located or positioned anywhere on the apparatus head 12. Preferably, the rake member 17 may be positioned proximate to the pick member 15.

Generally, the tool 100 may comprise a longitudinal axis line 24 (FIGS. 1-4) which may run centrally through the apparatus head 12 and optionally through portions of the handle 11 and/or optional handle extension 22. In some embodiments, the plurality of rake blades 18 of the rake member 17 may protrude outwardly away from the apparatus head 12 in a direction substantially perpendicular to the longitudinal axis line 24. In further embodiments, the handle 11 and apparatus head 12 may extend longitudinally along a longitudinal axis line 24 and the plurality of pick teeth 16 of the pick member 15 may protrude outwardly away from the distal end 14 of the apparatus head 12 parallel with the longitudinal axis line 24. In further embodiments, the handle 11, handle extension 22, and apparatus head 12 may extend longitudinally along a longitudinal axis line 24 and the plurality of pick teeth 16 of the pick member 15 may protrude outwardly away from the distal end 14 of the apparatus head 12 parallel with the longitudinal axis line 24.

Turning now to FIG. 3, a side elevation view of an alternative example of a paint brush cleaning tool 100 according to various embodiments is shown. In some embodiments and in this example, the proximal end 13 of the apparatus head 12 may be removably coupled to the second end 20 of the handle 11. The second end 20 of the handle 11 may comprise threading 25 which may be inserted into an aperture on the proximal end 13 of the apparatus head 12 which may comprise a complementary threading allowing the handle 11 to be removably coupled to the apparatus head 12. In other embodiments and as shown in FIG. 4, the proximal end 13 of the apparatus head 12 may be removably coupled to the handle extension 22. A portion of the handle extension 22 may comprise threading 25 which may be inserted into an aperture on the proximal end 13 of the apparatus head 12 which may comprise a complementary threading allowing the handle extension 22 to be removably coupled to the apparatus head 12. In further embodiments, the handle 11, apparatus head 12, and/or optional handle extension 22 may be removably coupled or removably connected by being press fit or snap fit together, by one or more fasteners such as hook and loop type or Velcro® fasteners, magnetic type fasteners, threaded type fasteners, sealable tongue and groove fasteners, snap fasteners, clip type fasteners, clasp type fasteners, ratchet type fasteners, a push-to-lock type connection method, a turn-to-lock type connection method, slide-to-lock type connection method or any other suitable temporary or removable connection method as one reasonably skilled in the art could envision to serve the same function. In still further embodiments, a handle extension 22 may be removably coupled to the second end 20 of a handle 11, and the handle extension 22 may be coupled or integrally formed with the proximal end 13 of the apparatus head 12.

Figure 5:
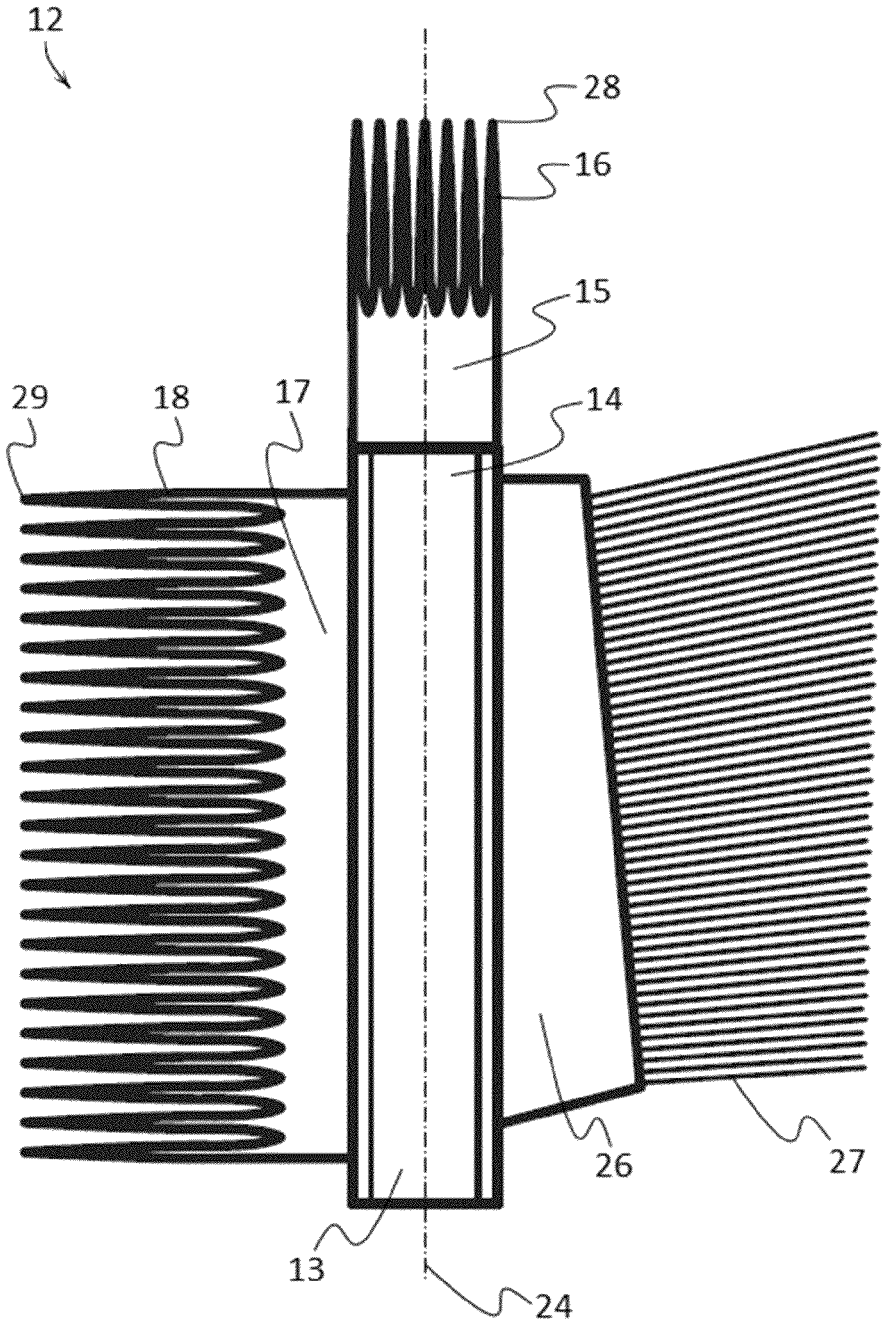
FIG. 5 depicts a side elevation view of an example of an apparatus head of a paint brush cleaning tool according to various embodiments described herein.
Figure 6:
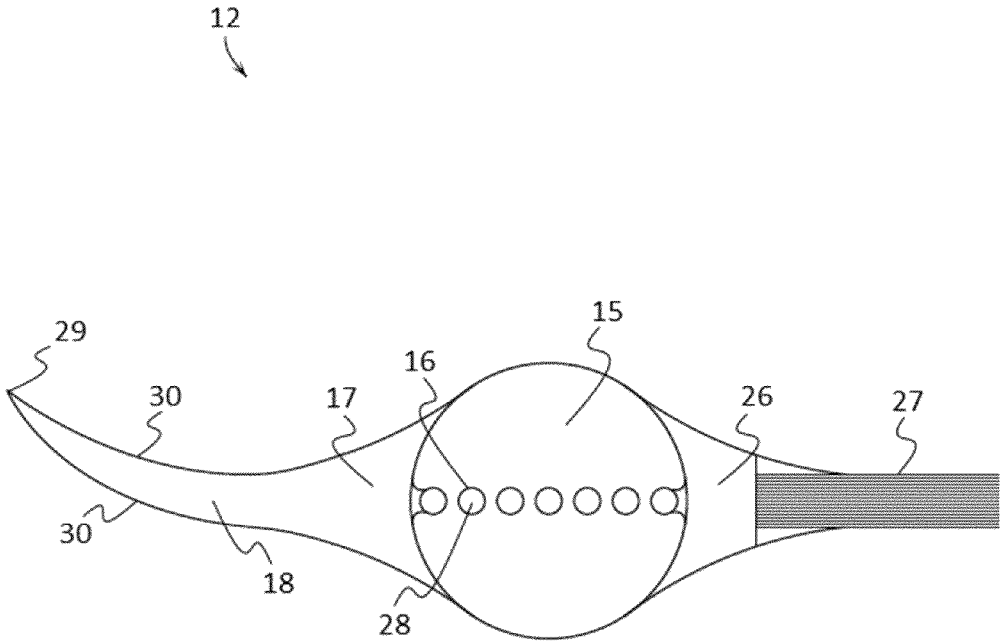
FIG. 6 depicts a top plan view of an example of an apparatus head of a paint brush cleaning tool according to various embodiments described herein.

As perhaps best shown in FIGS. 5 and 6, the pick member 15 may comprise a plurality of pick teeth 16 which may protrude outwards and away from the distal end 14 of the apparatus head 12 and the handle 11. The pick teeth 16 may protrude outwardly away from the distal end 14 of the apparatus head in a direction generally parallel with or to the longitudinal axis line 24. The rake member 17 may be positioned proximate to the pick member 15 and may comprise a plurality of rake blades 18. The plurality of rake blades 18 may protrude outwardly away from the apparatus head 12 in a direction substantially perpendicular to the longitudinal axis line 24. In some embodiments, the number of rake blades 18 may be greater than the number of pick teeth 16. In other embodiments, the number of rake blades 18 may be equal to the number of pick teeth 16. In still other embodiments, the number of rake blades 18 may be less than the number of pick teeth 16.

The pick member 15 may comprise two, three, four, five, six, seven, or more such as a plurality of pick teeth 16. In some embodiments, the pick teeth 16 may comprise a generally elongated cylinder shape and be configured to terminate with a pointed, blunt pointed, rounded, or similar shaped pick tooth terminus 28. The pick tooth terminuses 28 provided by the pick teeth 16 may facilitate the pick member 15 to be used to pull out or pick out embedded paint from a ferrule of a paint brush. In some embodiments, one or more of the pick teeth 16 may be separated from each other by a distance generally equal to the width of a pick tooth 16. In other embodiments, one or more of the pick teeth 16 may be separated from each other by a distance generally less than the width of a pick tooth 16. In still other embodiments, one or more of the pick teeth 16 may be separated from each other by a distance generally greater than the width of a pick tooth 16.

Similarly, the rake member 17 may comprise two, three, four, five, six, seven, or more such as a plurality of rake blades 18. The plurality of rake blades 18 may protrude outwardly away from the apparatus head 12 in a direction substantially perpendicular to the longitudinal axis line 24. One or more of the rake blades 18 may protrude outwardly and also curve away from the apparatus head 12 in a direction substantially perpendicular to the longitudinal axis 24. In some embodiments, the rake blades 18 may comprise a generally elongated elliptic cylinder shape which may comprise a blunt edge 30 on one or both sides of its major axis as shown in FIG. 6. In further embodiments, a rake blade 18 may be configured to terminate with a pointed, blunt pointed, rounded, or similar shaped rake blade terminus 29. The blunt edges 30 provided by the rake blades 18 may be rounded, beveled, or the like to facilitate the movement of the rake member 17 to move through or comb through the bristles of a paint brush to remove embedded paint without damaging the bristles. In some embodiments, one or more of the rake blades 18 may be separated from each other by a distance generally equal to the width of a rake blade 18. In other embodiments, one or more of the rake blades 18 may be separated from each other by a distance generally less than the width of a rake blade 18. In still other embodiments, one or more of the rake blades 18 may be separated from each other by a distance generally greater than the width of a rake blade 18.

In some embodiments, the pick teeth 16 may be generally similar in length and extend from the pick tooth terminuses 28 to the apparatus head 12 at for example between 0.1 and 5 inches. In other embodiments, one or more of the pick teeth 16 may have a different length than one or more other pick teeth 16. In some embodiments, the rake blades 18 may be generally similar in length and extend from the rake blade terminuses 29 to the apparatus head 12 at for example between 0.1 and 5 inches. In other embodiments, one or more of the rake blades 18 may have a different length than one or more other rake blades 18. In still further embodiments, one or more pick teeth 16 and/or rake blades 18 may be configured in a plurality of sizes and shapes including cylinder shaped, rectangular prism shaped, hexagonal prism shaped, triangular prism shaped, or any other geometric or non-geometric shape, including combinations of shapes. It is not intended herein to mention all the possible alternatives, equivalent forms or ramifications of the invention. It is understood that the terms and proposed shapes used herein are merely descriptive, rather than limiting, and that various changes may be made without departing from the spirit or scope of the invention while allowing a pick member 15 and a rake member 17 to function as described.

As shown in FIGS. 1-6 and in some embodiments, the tool 100 may comprise a brush member 26 comprising a plurality of brush bristles 27 which may protrude outwards and away from the apparatus head 12. The brush bristles 27 may be configured to protrude outwards and away from the apparatus head 12 in a direction substantially perpendicular to the longitudinal axis line 24. A brush member 26 may be positioned anywhere on the apparatus head 12 such as opposite a rake member 17. The brush member 26 may comprise a plurality of generally flexible brush bristles 27 which may be made from synthetic materials such as strands or lengths of nylon, polyester, peek, polyethylene, polypropylene, polystyrene, PTFE, PVC, any other synthetic bristle material, and/or natural materials such as strands or lengths of goat hair, hog bristle, horsehair, camel hair, ox hair, sable hair, skunk or fitch, squirrel, bass or piassava, bassine, kittool, palmetto, palmyra, rice root, tampico, union fiber, or any natural bristle material including metals and metal alloys. In some embodiments, the brush member 26 may comprise one or more rows of brush bristles 27 which may generally extend for example between approximately 0.1 to 5 inches along portions of the apparatus head 12 between the proximal end 13 and the distal end 14. In further embodiments, the brush bristles 27 may be of a generally uniform length, or the brush bristles 27 may comprise different lengths along different locations of the brush member 26. For example, the brush bristles 27 closer to the distal end 14 may be relatively longer than the brush bristles closer to the proximal end 13.

Also as shown in FIGS. 1-6, in some embodiments the rake member 17 may comprise a plurality of rake blades 18 which may protrude outwardly away from the apparatus head 12 in a direction substantially perpendicular to the longitudinal axis line 24 and the brush member 26 may comprise a plurality of brush bristles 27 which may protrude outwardly and away from the apparatus head 12 in a direction substantially perpendicular to the longitudinal axis line 24. In further embodiments and as shown in FIG. 6, the plurality of rake blades 18 may protrude outwardly and curve away from the apparatus head 12 in a direction substantially perpendicular to the longitudinal axis so that the rake blade terminus 29 may not be in generally the same plane as the brush bristles 27 and/or the pick teeth 16.

While some materials have been provided, in other embodiments, the elements that comprise the tool 100 such as the apparatus head 12, pick member 15, rake member 17, optional brush member 26, optional handle extension 22, and/or optional ring of containment 23 may be made from durable materials such as aluminum, steel, other metals and metal alloys, wood, hard rubbers, hard plastics, fiber reinforced plastics, carbon fiber, fiber glass, resins, polymers or any other suitable materials including combinations of materials. Additionally, one or more elements may be made from or comprise durable and slightly flexible materials such as soft plastics, silicone, soft rubbers, or any other suitable materials including combinations of materials. In some embodiments, one or more of the elements that comprise the tool 100 may be coupled or connected together with heat bonding, chemical bonding, adhesives, clasp type fasteners, clip type fasteners, rivet type fasteners, threaded type fasteners, other types of fasteners, or any other suitable joining method. In other embodiments, one or more of the elements that comprise the tool 100 may be coupled or removably connected by being press fit or snap fit together, by one or more fasteners such as hook and loop type or Velcro® fasteners, magnetic type fasteners, threaded type fasteners, sealable tongue and groove fasteners, snap fasteners, clip type fasteners, clasp type fasteners, ratchet type fasteners, a push-to-lock type connection method, a turn-to-lock type connection method, slide-to-lock type connection method or any other suitable temporary connection method as one reasonably skilled in the art could envision to serve the same function. In further embodiments, one or more of the elements that comprise the tool 100 may be coupled by being one of connected to and integrally formed with another element of the tool 100.

Although the present invention has been illustrated and described herein with reference to preferred embodiments and specific examples thereof, it will be readily apparent to those of ordinary skill in the art that other embodiments and examples may perform similar functions and/or achieve like results. All such equivalent embodiments and examples are within the spirit and scope of the present invention, are contemplated thereby, and are intended to be covered by the following claims.

What is claimed is:

1. A paint brush cleaning apparatus, the apparatus comprising:

a. a handle;

b. an apparatus head having a proximal end coupled to the handle and a distal end and wherein the handle and apparatus head extend longitudinally along a longitudinal axis line;

c. a pick member comprising a plurality of pick teeth protruding outwards and away from the distal end of the apparatus head parallel with the longitudinal axis line;

d. a rake member positioned proximate to the pick member and comprising a plurality of rake blades protruding outwardly and curving away from the apparatus head in a direction substantially perpendicular to the longitudinal axis line; and e. a brush member comprising a plurality of brush bristles protruding outwards and away from the apparatus head in a direction substantially perpendicular to the longitudinal axis line.

2. The apparatus of claim 1, wherein the apparatus head is removably coupled to the handle.

3. The apparatus of claim 1, wherein each of the plurality of rake blades have a blunt edge.

4. The apparatus of claim 1, wherein the number of rake blades is greater than the number of pick teeth.

5. A paint brush cleaning apparatus, the apparatus comprising:

a. a handle;

b. a handle extension coupled to the handle;

c. an apparatus head having a proximal end coupled to the handle extension and a distal end and wherein the handle, the handle extension, and the apparatus head extend longitudinally along a longitudinal axis line;

d. a pick member comprising a plurality of pick teeth protruding outwards and away from the distal end of the apparatus head parallel with the longitudinal axis line;

e. a rake member positioned proximate to the pick member and comprising a plurality of rake blades protruding outwardly and curving away from the apparatus head in a direction substantially perpendicular to the longitudinal axis line; and f. a brush member comprising a plurality of brush bristles protruding outwards and away from the apparatus head in a direction substantially perpendicular to the longitudinal axis line.

6. The apparatus of claim 5, wherein the apparatus head is removably coupled to the handle extension.

7. The apparatus of claim 5, wherein each of the plurality of rake blades have a blunt edge.

8. The apparatus of claim 5, wherein the number of rake blades is greater than the number of pick teeth.

* * * * *